United States Patent [19]

Yasuda et al.

[11] 3,947,171

[45] Mar. 30, 1976

[54] APPARATUS FOR PRODUCING PRECAST CONCRETE MEMBERS

[75] Inventors: Kazuyoshi Yasuda, Tokyo; Tokishige Tsuboi, Machida; Masashi Sudo, Tokyo, all of Japan

[73] Assignee: The Shimizu Construction Co., Ltd., Tokyo, Japan

[22] Filed: Dec. 11, 1972

[21] Appl. No.: 313,800

[30] Foreign Application Priority Data

Dec. 9, 1971 Japan ..... 46-99018

[52] U.S. Cl. ..... 425/88; 432/162

[51] Int. Cl.[2] ..... B28B 15/00; F27B 3/18

[58] Field of Search.... 425/88, DIG. 117, DIG. 118, 425/89; 264/DIG. 43, 333, 336, 297, 39; 432/153, 162; 214/16.1 R, 16.4 R; 280/33.99 T, 79.1, 79.2.79.3; 108/106, 109, 110; 211/128, 133, 134; 248/250

[56] References Cited

UNITED STATES PATENTS

| | | | |
|---|---|---|---|
| 1,353,229 | 9/1920 | Georgeson | 214/83.24 |
| 1,410,466 | 3/1922 | Gantvoort | 214/16.4 R |
| 1,859,878 | 5/1932 | Lockwood | 425/89 X |
| 1,894,167 | 1/1933 | Erith | 425/88 |
| 3,407,457 | 10/1968 | Blom | 425/88 |
| 3,523,343 | 8/1970 | Mitchell | 425/88 |
| 3,525,131 | 8/1970 | Schneider | 425/88 |
| 3,659,723 | 5/1972 | Konstant | 211/134 X |
| 3,659,986 | 5/1972 | Gelbman | 425/88 |
| 3,732,052 | 5/1973 | Gunia | 425/88 X |
| 3,739,050 | 6/1973 | Koncz | 425/88 X |
| 3,868,207 | 2/1975 | Otsuki | 425/88 X |
| 3,874,832 | 4/1975 | Ohta | 425/88 |

FOREIGN PATENTS OR APPLICATIONS

| | | | |
|---|---|---|---|
| 1,239,486 | 7/1960 | France | 425/404 |
| 316,417 | 10/1969 | Sweden | 214/16.4 C |

*Primary Examiner*—Francis S. Husar
*Assistant Examiner*—John S. Brown
*Attorney, Agent, or Firm*—Ostrolenk, Faber, Gerb & Soffen

[57] ABSTRACT

An apparatus for producing precast concrete members which is efficient, mobile and cost saving, and comprises at least: a curing chamber having an opening in the portion which faces substantially a concrete placing section and having a plurality of support members to support form members leaving predetermined distance apart, a high temperature curing apparatus which is installed to said curing chamber, a concrete placing section in which necessary work for concrete placing is carried out, and a predetermined number of precast concrete form members which are disposed and moved horizontally and separately between said support members in said curing chamber and said concrete placing section by horizontal transfer means which comprise a plurality of rollers attached to said support members.

4 Claims, 5 Drawing Figures

3
8
5
4

1
3
14
13
12
16
15

2
2'
3
4
8
9
22
23

APPARATUS FOR PRODUCING PRECAST CONCRETE MEMBERS

The present invention relates to an apparatus for producing precast concrete members. Further, the invention relates to an improved apparatus for producing the precast concrete members (hereinafter referred to as "PC member"), in which the concrete placing and curing are performed in multilayered arrangement and in a continuous procedure. The apparatus of the present invention is suitable for the production of the PC members at the construction site, as it is compact and mobile one.

The present invention provides a novel apparatus for producing the PC members which has several advantages in connection with horizontally oriented concrete placing forms, a savings of equipments and floor space in the vertically layered arrangement and the workability of the conveyer system. Further, the apparatus of the invention comprises several unit parts which can be assembled and disassembled without any trouble and difficulty. Therefore, the apparatus is very convenient for the production of the PC members at the construction site.

In the apparatus of the invention, the concrete placing section, with concrete form members, is positioned next to the curing chamber so that the preliminary work and placing of concrete can be carried out separately or concurrently in said sections to improve the workability.

Several steps in the production of the PC members by the apparatus of the invention can be carried out independently with regard to respective production lines. The control of the curing chamber is easy. The supply of the raw material concrete is convenient because fixed place production can be done. The inspection of the process is easy to facilitate the check of defects. There is no fear of delay caused by performance on one form member of the preceding and following steps.

Further, in the apparatus of the invention, the main portions comprise multi-layered unit bodies which are suitable for use with a mobile plant. In addition to that each form member can be introduced into or taken out from the curing chamber separately. Thus, the workability of each form member can be increased very much.

Still further, with regard to the apparatus of the invention, the working space is small as the apparatus is vertically arranged to save the cost for land. The preliminary work on the form member is carried out its respective one of the multi-layered support members. Each form member on a support member is moved independently with regard to other form members. The order or sequence of the work can be determined at will, and the work can be started from any form member. Thus the work hours can be used most efficiently. Furthermore, the complete cycle of production can be designed by providing each production line with a respective time schedule, and the taking out of the form members from the curing chamber can be performed at any time.

In order that the invention may be more fully understood, preferred embodiments and various supplementary features will be described with reference to the accompanying drawings, in which.

Figure 1:
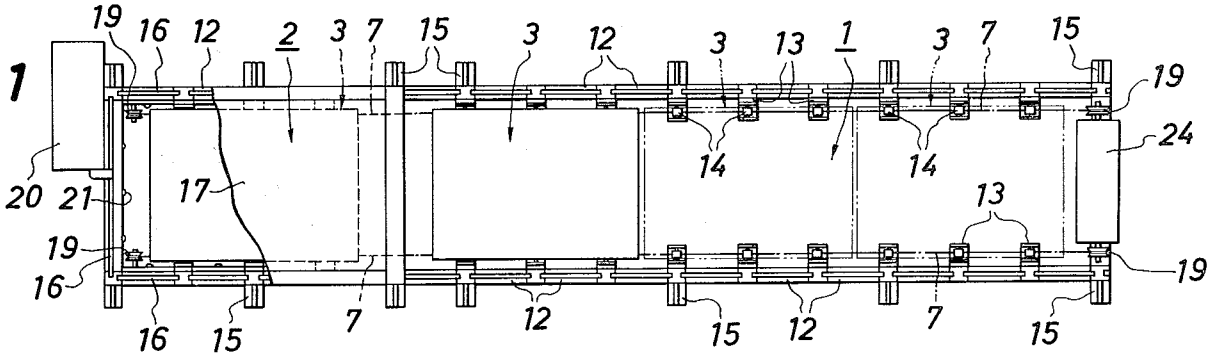
FIG. 1 is a plan view partly broken away of the first embodiment of the apparatus of the present invention in which the curing chamber is placed on one side of the concrete placing section.

In the following, the embodiment of the present invention will be explained according to the accompanying drawings. The apparatus of the invention generally comprises a concrete placing section 1, hereinafter referred to as "working section", a curing section 2 and form members 3.

Working section 1 will be explained further in accordance with FIGS. 1 to 3. Along both sides of the working section 1, frames 12 are provided in parallel with each other with proper intervals and strength to support said form members 3.

On the inside surface of each of said frames 12, a plurality of supporting members 13 are provided at certain intervals. The upper side of each supporting member 13 is provided with a roller 14. Each frame 12 is provided with a buttress 15 on the outside thereof, whereby the mechanical strength of the frames 12 is improved.

The distance between one frame 12 and another adjacent frame 12 may be such length that the form member 3 can be supported at any position in the longitudinal direction at two or more points. The length of said working section 1 must be sufficiently long so as to enable two or more of the concrete placing operation to be concurrently performed at two or more of the working levels when the two form members 3 are not vertically aligned and wherein the two form members are arranged one before the other, as in FIG. 1.

The curing chamber 2 is a box type prefabricated chamber which is formed by fitting the outer walls 16 and the roof 17 to said frame 12. The dimensions of the chamber 2 must be sufficient to store the PC slabs. The outer walls 16 and roof 17 are preferably standardized panels and are of some heat insulating material. The curing chamber 2 is located at one end portion of said working section 1, and the faces of said outer walls and roof of the curing chamber must be substantially coincided with the lines of said frames 12 and supporting members 13. The outer walls 16 are provided also with buttresses 15 on the outside thereof. A boiler 20 is installed on one side of said curing chamber 2, and high temperature steam is directed to the radiator 21 in the chamber 2 through pipes, thereby the conventional temperature regulation of the chamber can be accomplished.

The passageway of the curing chamber 2 is provided with closing members, for example, elastic partitions 18 made of rubber to form the side walls, thereby preventing the leakage of the hot air from the chamber 2.

Figure 4:
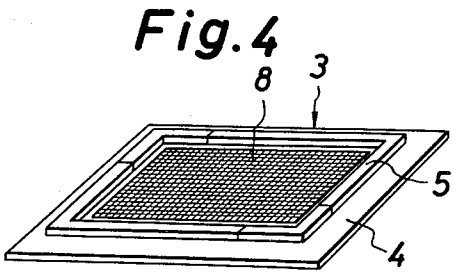
FIG. 4 is a perspective view of the form member for placing the fresh concrete.

The form members 3 for the preparation of PC members will be explained according to FIG. 4. The form member 3 consists of a smooth and solid pallet 4 to support the bottom of the PC member, peripheral frame 5 and other known parts which are used for the assembling and disassembling of the form member 3 for the moulding of PC member. Form member 3 is supported on each stage on two or more of the supporting members 13 of the frames 12 on each side in said working section 1 or the curing chamber 2. Thereby, the form member 3 can be shifted horizontally within the section 1 and the supporting members 13. The driving means for the movement of this form member 3 may be any known devices. In the embodiment as shown in FIGS. 1 and 2, the pallet 4 is provided with wire ropes 7 which are extended through the hanging member 19 and is shifted by the power of a winch (not shown). In FIG. 4, reinforcing steels 8 for the PC member are placed in the peripheral frame 5. The numeral 9 in FIG. 5 indicates a completed PC member taken out from the form member 3.

Figure 2:
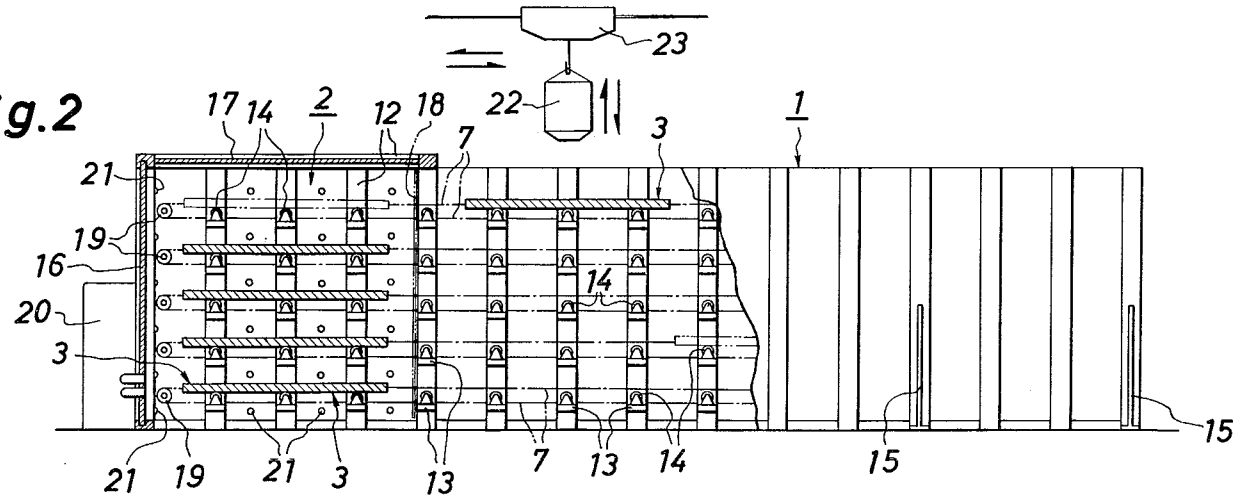
FIG. 2 is a vertical sectional view of the curing chamber and a part of the concrete placing section.
Figure 3:
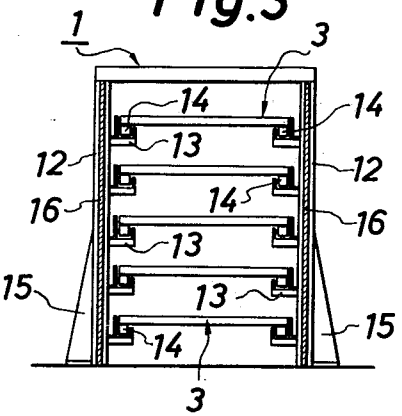
FIG. 3 is a sectional view of the concrete placing section.
Figure 5:
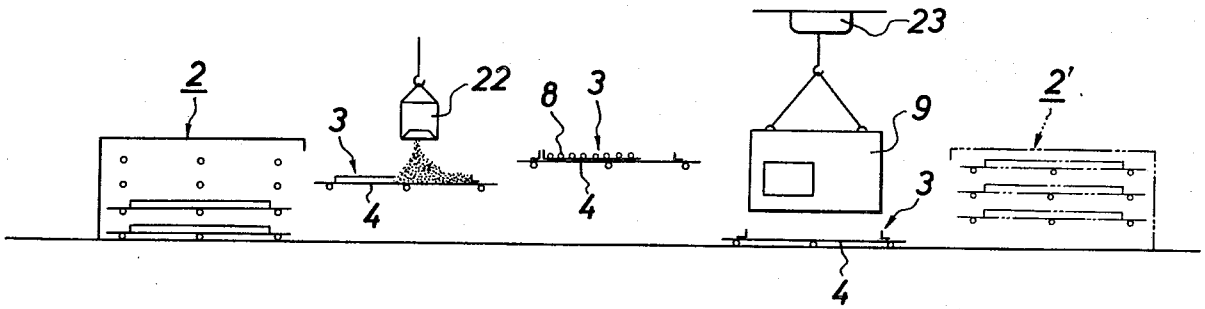
FIG. 5 is a schematic illustration of the production process.

Further, in FIGS. 1, 2 and 5, the numeral 22 indicates a bucket for feeding fresh concrete which is commonly used in the PC member producing apparatus, 23 indicates a crane for lifting the PC members, said bucket etc. and 24 indicates an elevator for operators of the apparatus.

The process for producing PC members using the apparatus of the present invention will be explained in the following.

The pallets 4 are, in the first place, positioned on the supporting members 13 of the frames in the working section 1 and the following steps are carried out by the operators: cleaning — assembling of the form member — setting of the reinforcing steel and so forth (including dispositions of structural joints, auxiliary frames of opening portions and pipings and wirings) — placing of the fresh concrete - concrete surface finishing — releasing from the form. In the steps, after said concrete placing step, the whole of the form member 3 including the placed concrete is transferred into the curing chamber 2, in which the concrete material is preheated. After the excessive water subsides, the form member 3 is taken out from the chamber 2. Then the surface finishing is carried out, and the form member 3 is put into the curing chamber 2 again in order to cure completely. Thereafter, the PC member is taken out from the form member 3 and is laid in the depository yard. The above-mentioned steps are well known ones in the field of the invention concerned, it is the characteristic feature of the apparatus of the invention that the other pallets 4 can be continuously worked on other working layers and positions, which provides far superior workability. In the embodiment as disclosed in the above, the working section 1 and the curing chamber 2 make a pair naturally, while as shown in FIG. 5 with the chain lines, another curing chamber 2′ can be provided on the other side of the working section 1. Thereby, the work in the working section 1 can be carried out smoothly and each step of the production process can be proceeded more effectively.

Further the whole parts of the present apparatus are unitized. Therefore the assembling and disassembling of the apparatus are easy, the transportation of the disassembled apparatus is also easy and the juxtaposition or extension of the unit apparatus is of course possible. Accordingly, the apparatus of the present invention is suitable as a mobile apparatus in proportion to the scale of the construction site. In addition, it can be conveniently used as a stationary apparatus.

It should be emphasized, however, that the specific embodiments described and shown herein are intended as merely illustrative and in no way restrictive of the invention.

What is claimed is:

1. An apparatus for producing precast concrete members, comprising:

a curing chamber in which concrete is to be cured; said curing chamber having an entrance side facing toward a concrete placing section;

a concrete placing section in which the work for concrete placing in form members is performed; said concrete placing section having an entrance side facing toward said curing chamber side;

a pair of laterally spaced, parallel, vertically extending and vertically oriented frame means which extend longitudinally between and through said curing chamber and said concrete placing section; a plurality of spaced apart vertical layers defined on and extending longitudinally along each said frame means, with corresponding said vertical layers on both said frame means being horizontally aligned;

a respective plurality of form members supporting rollers on every said layer of both said frame means; each of said rollers on one of said frame means being paired with one of said rollers on the other of said frame means defining a plurality of roller pairs; both said rollers of each said pair being horizontally aligned longitudinally along both said frame means;

support means on both said frame means for supporting each said roller near to its respective said frame means and at a location between both said frame means; said support means and said rollers being shaped and positioned to define an open area in the intermediate space between the said rollers of each said roller pair;

a plurality of precast concrete form members; at least one said form member being supported on some of said roller pairs at each said vertical layer; the length, measured in the longitudinal direction along said frame means, of each said form member and the spacing between adjacent said roller pairs on a said layer being coordinated such that each said form member is continuously supported from beneath by at least two said roller pairs as said form member is moved longitudinally along said frame means; the width of each said form member is such that it is supported on both rollers of each said pair it is then being supported upon;

all said support means and said rollers being so shaped and positioned that concrete poured from above said concrete placing section will pass by all said layers of said roller pairs without interference with its passage until the poured concrete falls on a said form member that has been located in said concrete placing section beneath the pouring concrete;

moving means for moving each said form member longitudinally along said frame means and along its respective said layer between said curing chamber and said concrete placing section.

2. The apparatus for producing precast concrete members of claim 1, wherein said form members are generally elongated in two dimensions and are considerably shorter in their third dimension; the shorter said dimension of said form members being the vertical dimension thereof, whereby said form members lie flat generally horizontally as they are moved.

3. The apparatus for producing precast concrete members of claim 1, wherein said moving means comprise a respective rope means connected to each said form member and extending the length of said frame means; hanging means for each said rope means located at the longitudinal ends of said frame means such that drawing upon each said rope means moves past its said hanging means and moves its said form member.

4. The apparatus for producing precast concrete members of claim 1, further comprising means for feeding fresh concrete to said form members on all said vertical layers and being located above all said layers.

* * * * *